United States Patent [19]

Zimmermann

[11] Patent Number: 4,925,166

[45] Date of Patent: May 15, 1990

[54] GAS FLUSHING BRICK FOR METALLURGICAL VESSELS

[75] Inventor: Harry Zimmermann, Vaduz, Switzerland

[73] Assignee: PA-HA-GE Hutten und Giessereibedarf GmbH & Co. KG, Viersen, Fed. Rep. of Germany

[21] Appl. No.: 255,549

[22] Filed: Oct. 7, 1988

[30] Foreign Application Priority Data

Oct. 14, 1987 [DE] Fed. Rep. of Germany ..... 3734713

[51] Int. Cl.[5] ..... C21C 5/48

[52] U.S. Cl. ..... 266/270; 266/218

[58] Field of Search ..... 266/218, 224, 220, 265, 266/266, 270

[56] References Cited

U.S. PATENT DOCUMENTS

| | | | |
|---|---|---|---|
| 4,340,208 | 7/1982 | Vayssiere et al. | 266/220 |
| 4,378,106 | 3/1983 | Hirschberg et al. | 266/218 |
| 4,438,907 | 3/1984 | Kimura et al. | 266/270 |
| 4,647,020 | 3/1987 | Liesch et al. | 266/270 |
| 4,711,432 | 12/1987 | Heinz et al. | 266/270 |
| 4,741,515 | 5/1988 | Sharma et al. | 266/266 |

FOREIGN PATENT DOCUMENTS

| | | | |
|---|---|---|---|
| 0080403 | 6/1983 | European Pat. Off. | 266/265 |
| 0230217 | 7/1987 | European Pat. Off. . | |
| 3606322 | 9/1987 | Fed. Rep. of Germany . | |
| 53932 | 6/1967 | Luxembourg . | |
| 1293234 | 2/1987 | U.S.S.R. | 266/270 |

OTHER PUBLICATIONS

Patent Abstracts of Japan, vol. 5, No. 22, Feb. 10, 1981, 55-1497 50.

*Primary Examiner*—Robert McDowell

[57] ABSTRACT

In a flushing brick for metallurgical vessels comprising a shaped brick having a gas distributor connected to a gas supply pipe and gas passages the gas passages lead out of a wind box and are surrounded in a gas-tight manner by a protective tube that keeps the outer part of the shaped brick free from the pressure of the flushing gas.

10 Claims, 1 Drawing Sheet

GAS FLUSHING BRICK FOR METALLURGICAL VESSELS

TECHNICAL FIELD OF THE INVENTION

The invention relates to a gas flushing brick for metallurgical vessels comprising a shaped brick having a gas distributor connected to a gas supply pipe and gas passages.

BACKGROUND OF THE INVENTION AND PRIOR ART

In secondary metallurgy metallurgical vessels are used that have in their base a gas flushing brick which in general is replaceable and through which an inert gas, for example argon, is blown into the melt to be treated. Such flushing bricks may be made of a porous shaped brick and the flushing gas may issue through their front face in finely divided form, or they may have gas passages through which the flushing gas enters the melt at the front face of the flushing brick or shaped brick. In addition, so-called joint or gap flushers are known in which a shaped brick of refractory material is surrounded by a sheet metal jacket and the flushing gas passes out peripherally between the shaped brick and the sheet metal jacket and enters the melt.

Such a joint flusher having a shaped brick of refractory material is known from German Offenlegungsschrift 36 06 322, and consists of a base plate having a central gas supply pipe connected to a conical sheet metal jacket. In the jacket there is a shaped brick surrounded by a gas-permeable layer of cement. The shaped brick rests on spacers so that beneath it a gas distribution chamber is formed which is connected to and has the same area as the gas supply pipe through which the flushing gas enters the cement layer.

Since the gas distributing chamber extends as far as the gas-tight metal jacket, the shaped brick is subjected over its whole bottom surface to the extraordinarily high pressure of the flushing gas. Furthermore in the case of such flushing bricks the different coefficients of expansion of the sheet metal jacket and the refractory material of the brick can result in expansion cracks and to the formation of additional gaps through which flushing gas issues uncontrolled. At the places where the gas issues there is then as a rule accelerated wear of the shaped brick, leading to early failure of the flushing brick. Reduction is the size of the bottom surface to reduce the pressure loading on the shaped brick is mostly not possible, since this also reduces the taper of the flushing brick. This gives rise to difficulties in replacing the flushing brick, since a certain minimum taper is necessary for easy handling.

From European application 230 217 a conical flushing brick without a sheet metal jacket is also known in which the gas supply pipe passes through a base plate of sheet metal and ends directly in the refractory material of the flushing brick. Generally L-shaped gas passages leads radially from the supply pipe, which follow the taper of the flushing brick and end in its front face.

This flushing brick is however extraordinarily expensive in material and construction because of the number of gas-conducting pipes embedded in the refractory material.

Furthermore, particularly in the case of flushing bricks of large section, the high gas pressure on the melt side can also lead to spalling and microcracks parallel to the refractory side. This danger is particularly great in view of the cooling effect of the flushing gas, which can lead to high internal stresses that break off whole pieces from the flushing brick. The associated discontinuous wear quickly leads to failure of the whole flushing brick.

OBJECT OF THE INVENTION

The object of the invention is therefore to avoid the above-mentioned disadvantages of the known flushing bricks and more particularly to provide a flushing brick of which the shaped brick is largely kept free of the pressure of the flushing gas.

SUMMARY OF THE INVENTION

The idea underlying the invention is to separate the function of sealing to the brickwork surrounding the flushing brick from that of replacing the flushing brick. Accordingly the invention consists in having the gas passage in a flushing brick of the above-mentioned kind lead off from a wind box and be surrounded in a gas-tight manner by a protective tube. The refractory material of the shaped brick outside the protective tube is therefore not exposed to the pressure of the flushing gas.

The wind box preferably has a substantially smaller diameter than the shaped brick; its diameter can be the same as the diameter of the protective tube, which is particularly advantageous when the wind box and the protective tube are connected to one another in a gas-tight manner or if the wind box is part of the protective tube. Preferably the ratio of the diameters of the base of the shaped brick and the wind box is from 2:1 to 8:1.

If the lower part of the protective tube serves as the wind box, the supply pipe opens directly into the protective tube, which can extend as far as the front face of the shaped brick.

The individual gas passages, which are preferably made slit-shaped or with a narrow rectangular section, are surrounded by refractory material that fills the protective tube. The major transverse axes of the flushing gas passages may run radially with a core of the refractory material between them.

To facilitate replacement, the shaped brick may have a conical form and/or be surrounded by a sheet metal jacket. In addition, the base of the shaped brick rests on a plate of sheet metal which is preferably welded to the sheet metal jacket and opens into the gas supply pipe.

BRIEF DESCRIPTION OF THE DRAWINGS

The invention will now be explained in more detail in the exemplary embodiment shown in the drawings, in which.

DETAILED DESCRIPTION OF A PREFERRED EMBODIMENT OF THE INVENTION

Figure 1:
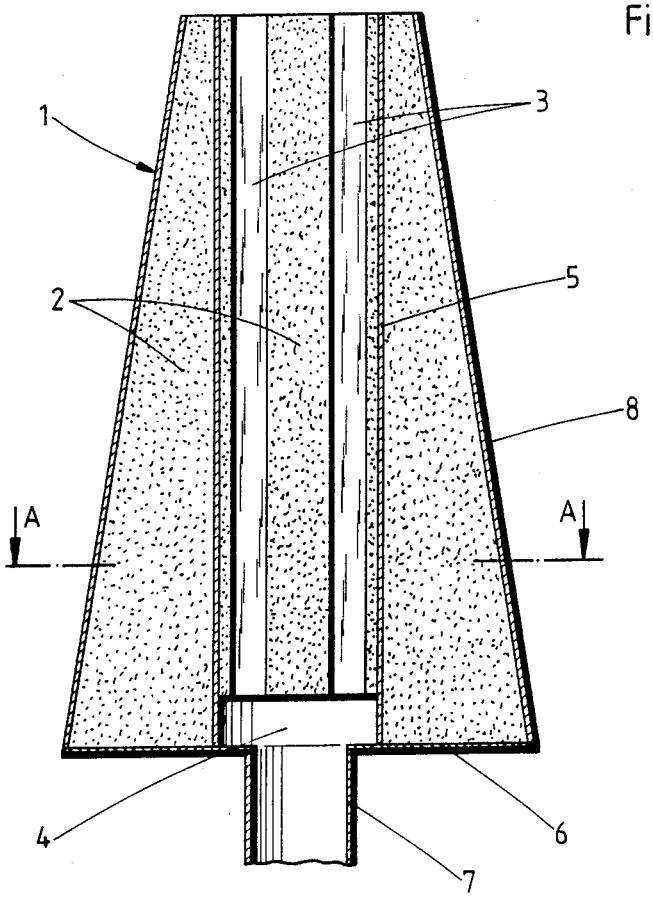
FIG. 1 shows an axial longitudinal section through the flushing brick.
Figure 2:
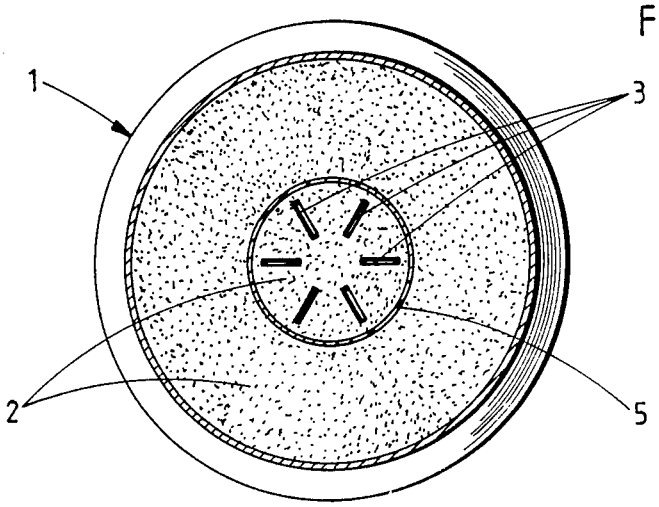
FIG. 2 shows a section on the line A—A in FIG. 1.

The flushing brick 1 shown consists of a shaped brick 1 of refractory material 2 and has slit-shaped flushing gas passages grouped radially around the refractory core of the shaped brick 1. The flushing gas passages 3 lead out of a wind box 4 which is located in the lower part of a protective tube concentrically surrounding the flushing gas passage 3. Such a wind box can easily be produced by keeping a part of the protective tube 5 free from refractory material when forming the passages 3 by means of a core. The protective tube 5 is welded gas-tight to a sheet metal disc 6 into which a supply pipe 7 for the flushing gas opens centrally. This sheet metal disc can in turn be welded to a sheet metal jacket surrounding the flushing brick.

Additionally, the flushing brick can be surrounded by a sheet metal envelope 8.

What is claimed is:

1. A flushing brick for metallurgical vessels comprising a shaped brick of refractory material having a wind box connected to a gas supply pipe and gas passages, wherein the gas passages lead from the wind box and are surrounded in a gas-tight manner by a protective tube arranged in the refractory material so that the gas passages are also directly surrounded by the refractory material.

2. A flushing brick according to claim 1 wherein the wind box has a substantially smaller diameter than the shaped brick.

3. A flushing brick according to claim 1 wherein the wind box and the protective tube have the same diameter.

4. A flushing brick according to claim 3 wherein the lower part of the protective tube forms the box.

5. A flushing brick according to claim 1 wherein the protective tube extends beyond the centre of the shaped brick.

6. A flushing brick according to claim 1 wherein the gas passages are slit-shaped.

7. A flushing brick according to claim 6 wherein the major transverse axis of the gas passage runs radially with respect to the protective tube and there is a core of refractory material between the gas passages.

8. A flushing brick according to claim 1 wherein the shaped brick is conical in shape.

9. A flushing brick according to claim 1 wherein the shaped brick is surrounded by a sheet metal jacket.

10. A flushing brick according to claim 1 wherein the base of the shaped brick rests on a sheet metal disc.

* * * * *